US010099148B2

(12) United States Patent
Burger

(10) Patent No.: US 10,099,148 B2
(45) Date of Patent: Oct. 16, 2018

(54) AMUSEMENT PARK RIDE WITH MOVABLE TRACK SECTION

(71) Applicant: MACK RIDES GMBH & CO. KG, Waldkirch (DE)

(72) Inventor: Günter Burger, Waldkirch (DE)

(73) Assignee: MACK RIDES GMBH & CO. KG, Waldkirch (DE)

( * ) Notice: Subject to any disclaimer, the term of this patent is extended or adjusted under 35 U.S.C. 154(b) by 199 days.

(21) Appl. No.: 15/030,314

(22) PCT Filed: Nov. 5, 2014

(86) PCT No.: PCT/EP2014/073818
§ 371 (c)(1),
(2) Date: Apr. 18, 2016

(87) PCT Pub. No.: WO2015/067658
PCT Pub. Date: May 14, 2015

(65) Prior Publication Data

US 2016/0243451 A1 Aug. 25, 2016

(30) Foreign Application Priority Data

Nov. 11, 2013 (DE) ..... 10 2013 222 910

(51) Int. Cl.
*A63G 7/00* (2006.01)
*A63G 9/00* (2006.01)
*A63G 21/18* (2006.01)

(52) U.S. Cl.
CPC ..... *A63G 7/00* (2013.01); *A63G 9/00* (2013.01); *A63G 21/18* (2013.01)

(58) Field of Classification Search
CPC . A63G 3/00; A63G 7/00; A63G 21/00; A63G 21/04; A63G 21/06; A63G 21/18
See application file for complete search history.

(56) References Cited

U.S. PATENT DOCUMENTS 1,546,375 A * 7/1925 Geiser ..... A63G 27/00 104/79
1,730,265 A 10/1929 Bulmer
(Continued)

FOREIGN PATENT DOCUMENTS

CN 2441530 Y 8/2001
CN 201279386 Y 7/2009
(Continued)

OTHER PUBLICATIONS

SIPO office action for related Chinese application 2014 8006 1788.5, dated May 2, 2017.
(Continued)

*Primary Examiner* — Robert J McCarry, Jr.
(74) *Attorney, Agent, or Firm* — William Gray Mitchell

(57) ABSTRACT

The invention relates to an amusement park ride with a guide track which has a first pivot axis for the movable guidance of the guide track, wherein the guide track is retained in a movable manner along the first pivot axis by way of a first retaining means, wherein the first pivot axis is oriented in a first axial direction, perpendicular to the direction of the guide track on the first pivot axis, and can be moved perpendicularly to the first axial direction. According to the invention, the guide track has a second pivot axis for the movable guidance of the guide track, wherein the guide track is retained in a movable manner along the second pivot axis by way of a second retaining means, and the second pivot axis is oriented in a second axial direction, perpendicular to the direction of the guide track on the second pivot axis, and can be moved perpendicularly to the second axial direction.

20 Claims, 3 Drawing Sheets

(56) References Cited

U.S. PATENT DOCUMENTS

| | | | | |
|---|---|---|---|---|
| 4,973,042 | A * | 11/1990 | Klopf | A63G 1/00 104/79 |
| 6,237,499 | B1 * | 5/2001 | McKoy | A63G 33/00 104/292 |
| 6,872,144 | B2 | 3/2005 | Kroon et al. | |
| 2003/0217667 | A1 * | 11/2003 | Bussink | A63G 7/00 104/53 |
| 2009/0193997 | A1 * | 8/2009 | Payne | A63G 21/06 104/53 |
| 2012/0258812 | A1 | 10/2012 | Osterman et al. | |

FOREIGN PATENT DOCUMENTS

| | | | |
|---|---|---|---|
| CN | 101730568 | A | 6/2010 |
| CN | 102083507 | A | 6/2011 |
| CN | 102961872 | A | 3/2013 |
| DE | 198 09 641 | A1 | 9/1999 |
| DE | 10 2006 032 239 | A1 | 1/2008 |
| DE | 10 2006 038 308 | A1 | 2/2008 |
| DE | 20 2012 104 141 | U1 | 3/2014 |
| EP | 1 364 691 | A1 | 11/2003 |
| EP | 1364691 | B1 | 9/2013 |
| GB | 2 278 291 | A | 11/1994 |
| GB | 2278291 | A | 11/1994 |
| JP | H10854507 | A | 4/1998 |

OTHER PUBLICATIONS

German PTO office action for related application DE 10 2013 222 910.0, dated Apr. 29, 2014.

International search report for related application PCT/EP2014/073818, dated Feb. 3, 2015.

Chinese PTO office action for related application 201480061788.5, dated Feb. 11, 2018.

* cited by examiner

AMUSEMENT PARK RIDE WITH MOVABLE TRACK SECTION

STATEMENT REGARDING FEDERALLY SPONSORED RESEARCH OR DEVELOPMENT

No federal government funds were used in researching or developing this invention.

CROSS REFERENCE TO RELATED APPLICATIONS

This patent application claims priority International Patent Application PCT/EP2014/073818, filed on Nov. 5, 2014, and thereby to German Patent Application 10 2013 222 910.0, filed on Nov. 11, 2013.

NAMES OF PARTIES TO A JOINT RESEARCH AGREEMENT

Not applicable.

SEQUENCE LISTING INCLUDED AND INCORPORATED BY REFERENCE HEREIN

Not applicable.

BACKGROUND

Field of the Invention

The present invention relates to an amusement park ride, particularly for fairs and amusement parks according to invention described herein. In particular, the invention relates to a track section of an amusement ride guided by rails.

Background of the Invention

Amusement equipment for rides frequently provide for the installation of fixed rail sections, on which vehicles are moved in a guided fashion, such as in roller coasters. DE 198 09 641 A1 discloses for example such an amusement ride, in which a passenger cabin travels in a guided fashion on rails over track sections with the track showing alternating inclinations. The track shows two track sections, projecting vertically upwards, which are connected to each other in a vertical level essentially by a semicircular arc section. In such amusement rides frequently tiring effects develop rather quickly for the passenger, primarily by the periodically repeated upwards and downwards motion.

In order to increase the attractiveness for the customer or rider there is the trend to design the track itself in a more mobile fashion. For example, EP 1 364 691 B1 disclosed a track section arranged on a rocker, on which a vehicle with passengers travels from one end to the other end and back again to the first end, with the track similar to a seesaw being pivoted back and forth about a single pivotal axis. Even in such a track a tiring effect quickly develops in the user, because the motions follow a periodic and thus soon detected pattern. The track progression on which the vehicle rides is determined by the shape of the rail and the stationary pivotal axis about which the track is pivoted.

The objective of the following invention is therefore to provide an amusement ride in which the track progression cannot easily be predicted by the passenger and which thus can offer particular thrills to the rider.

This objective is attained in an amusement ride, including advantageous embodiments thereof, as described herein.

BRIEF SUMMARY OF THE INVENTION

In a preferred embodiment, an amusement ride (1) comprising a guide track (2) which comprises a first pivotal axis (6) for the mobile guidance of a guide track (2) as well as a second pivotal axis (8) for the mobile guidance of the guide track (2), a first mobile fastening (10), as well as a second mobile fastening (12), with the guide track (2) being fastened in an articulate fashion with the first mobile fastening (10) at the first pivotal axis (6) and being fastened with the second mobile fastening (12) at the second pivotal axis (8) in a mobile and pivotal fashion, characterized in that the first pivotal axis (6) is pivotal about at least a first axial direction and the second pivotal axis (8) is pivotal about at least a second axial direction.

In another preferred embodiment, the amusement ride (1) as described herein, characterized in that the pivotal axes (6, 8) are mobile such that the guide track (2) can be moved translationally.

In another preferred embodiment, the amusement ride (1) as described herein, characterized in that the first axial direction is arranged aligned at the first pivotal axis (6) perpendicular in reference to the direction of the guide track (2).

In another preferred embodiment, the amusement ride (1) as described herein, characterized in that the guide track (2) comprises at least one vehicle (4) guided in a mobile fashion and held at a guide track (2).

In another preferred embodiment, the amusement ride (1) as described herein, characterized in that the guide track (2) is arranged extending between the first pivotal axis (6) and the second pivotal axis (8) parallel in reference to a level which is perpendicular to the axial direction of the first pivotal axis (6).

In another preferred embodiment, the amusement ride (1) as described herein, characterized in that the guide track (2) extends between the first and the second pivotal axis (6, 8) in a straight or twisted fashion.

In another preferred embodiment, the amusement ride (1) as described herein, characterized in that the first and/or the second pivotal axis (6, 8) are mobile parallel or in reference to the direction of the guide track (2).

An amusement ride (1) according to one of the previous claims, characterized in that the first axial direction is parallel in reference to the second axial direction.

In another preferred embodiment, the amusement ride (1) as described herein, characterized in that the first fastening of the guide track (2) is arranged adjacent to the second fastening of the guide track, with between the first and the second fastening the guide track (2) comprising no fastening fixing the position of the guide track (2) in reference to the erection site of the guide track (2) or no fastening holding the guide track (2).

In another preferred embodiment, the amusement ride (1) as described herein, characterized in that the first fastening (10) is formed by the first lifting rods (10), which are arranged pivotally at the first pivotal axis (6), and that the second fastening (12) is formed by second lifting rods (12), which are arranged pivotal at the second pivotal axis (8).

In another preferred embodiment, the amusement ride (1) as described herein, characterized in that the first lifting rods (10) are connected to a stationary arranged motor drive (14, 16) which changes the angle of the lifting rods (10, 12) in reference to the guide track (20) when it is switched on.

In another preferred embodiment, the amusement ride (1) as described herein, characterized in that the first and/or second lifting rods (10, 12) comprise lifting cylinders or are connected to lifting cylinders.

In another preferred embodiment, the amusement ride (1) as described herein, characterized in that the vehicle (4) shows wheels, by which it can be moved on the guide track.

In another preferred embodiment, the amusement ride (1) as described herein, characterized in that the vehicle (4) comprises a drive motor as well as preferably brakes.

In another preferred embodiment, the amusement ride (1) as described herein, characterized in that the guide track (2) is at least partially arranged in a water reservoir, with the guide tack (2) being at least partially arranged underneath the water level of the water reservoir.

In another preferred embodiment, the amusement ride (1) as described herein, characterized in that the vehicle (4) is a boat.

In another preferred embodiment, the amusement ride (1) as described herein, characterized in that the guide track (2) is a watercraft, the first mobile fastening (10) is a first rope (10) fastened at the watercraft (72), and the second mobile fastening (12) is a second rope (12) fastened at the watercraft.

In another preferred embodiment, the amusement ride (1) as described herein, characterized in that the vehicle (4) can be moved from one end of the guide track (2) to the other end of the guide track (2).

In another preferred embodiment, the amusement ride (1) as described herein, characterized in that the guide track (2) is connected at least at one of its ends to another guide track, when the vehicle (4) has reached at least one end of the guide track (2).

In another preferred embodiment, the amusement ride (1) as described herein, characterized in that the guide track (2) is embodied as a waterslide.

An amusement ride (1) according to claim 20, characterized in that the waterslide comprises several channels preferably embodied parallel in reference to each other as individual slides.

DETAILED DESCRIPTION OF THE INVENTION

Figure 1:
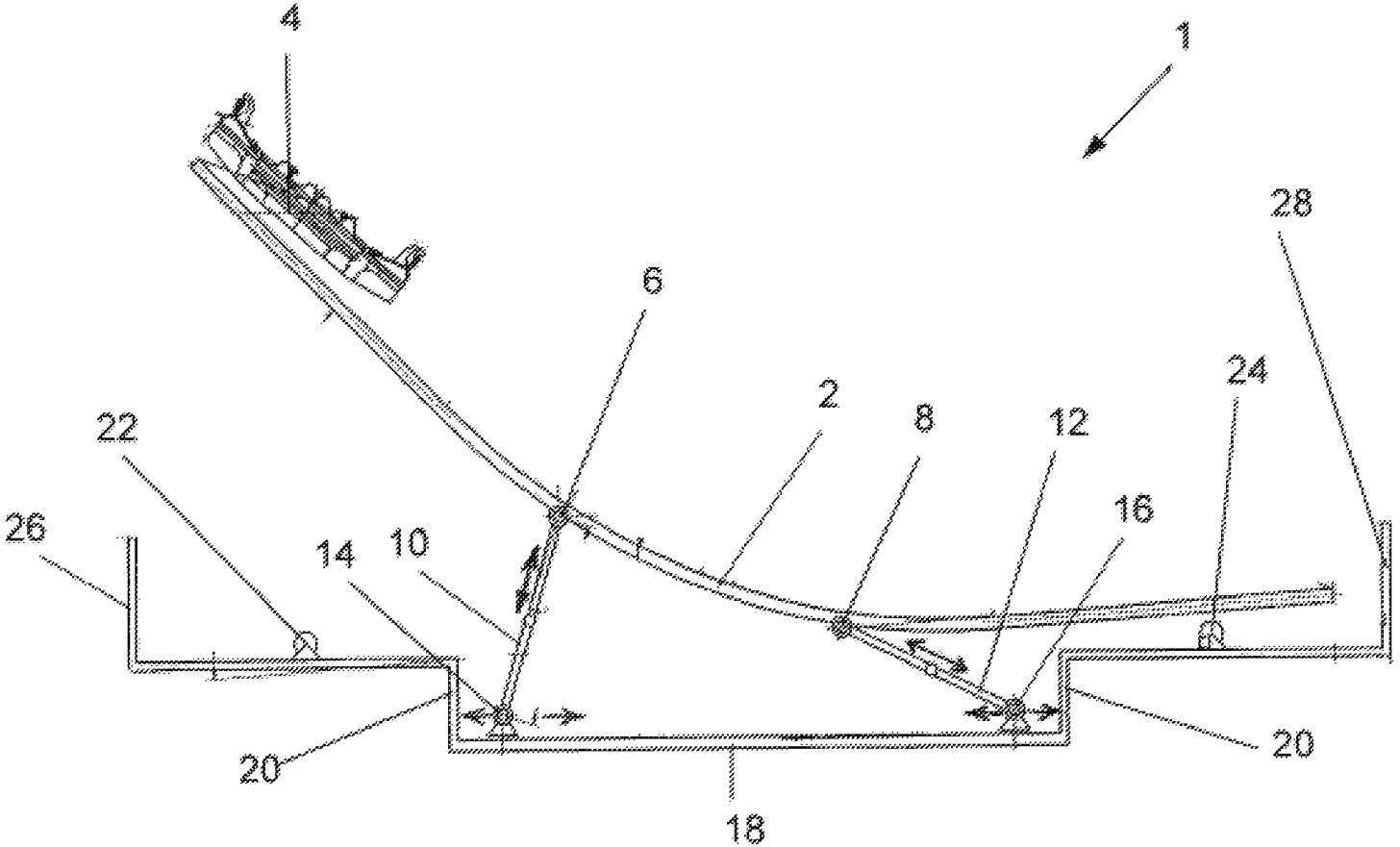
FIG. 1 is a line drawing evidencing a cross-section of an amusement ride according to the invention.

I disclose an amusement ride comprising a guidance track, which shows a first pivotal axis for the mobile guidance of the guide track as well as a second pivotal axis for the mobile guidance of the guide track. Furthermore, the amusement ride shows a first mobile fastening as well as a second mobile fastening. The guide track is fastened at the first pivotal axis with a first mobile fastening in a mobile and pivotal fashion and fastened at the second pivotal axis with the second mobile fastening in a mobile and pivotal fashion.

According to the invention, the first pivotal axis (6) is pivotal about at least a first axial direction and the second pivotal axis is pivotal about at least a second axial direction. The track progression is then not easily predictable by the passenger, which can offer particular moments of surprise. For example, such a mobile guide track can be adjusted such that it tilts, resulting in that the passenger is given the impression that vehicle and rider fall out of the track, which particularly at high elevations above the ground or in a water basin can lead to particularly amusing moments for the passenger.

The axis of the first axial direction may be arranged outside the guide track, for example in a mobile fashion, so that the first pivotal axis is pivotal about the axis of the first axial direction. The axis of the second axial direction may be arranged outside the guide track, for example in a mobile fashion so that the second pivotal axis is pivotal about the axis of the second axial direction. This way, for example a translational motion of the guide track can be permitted. The first fastening and the second fastening only need to be coupled to each other via the first and the second pivotal axis and the guide track. For the rest, they may be moved independent from each other.

Advantageously the pivotal axes of the amusement ride are also articulate such that the guide track is moved in a translational fashion. The rider is then given the impression that suddenly no longer the vehicle he/she is riding in is moving, which can lead to additional moments of surprise. For example, with this effect of a rail arranged in a water reservoir the swinging on a large wave can be simulated, which is not possible in devices that only allow performing pivoting motions.

The first axial direction can be arranged pointing perpendicular in reference to the guide track at the first pivotal axis, for example at the first pivotal axis.

On embodiment of the amusement ride according to the invention comprises a guide track which shows a first pivotal axis for the mobile guidance of the guide track, with the guide track being fastened in an articulate fashion at the first pivotal axis with a first fastening, and with the first pivotal axis furthermore being arranged pointing in a first axial direction, perpendicular to the direction of the guide track at the first pivotal axis, and being mobile perpendicular to the first axial direction. According to the invention the guide track comprises a second pivotal axis for the mobile guidance of the guide track, with the guide track being fastened at the second pivotal axis with a second fastening, and the second pivotal axis is arranged pointing in a second axial direction, perpendicular to the direction of the guide track at the second pivotal axis, and being mobile perpendicular to the second axial direction.

Unlike a mere to and fro pivoting motion, such a track can mimic for example the actual swaying motion of a ship on large waves.

The guide track shows at least one vehicle held at the guide track and guided thereby in a mobile fashion. Such an amusement device offers additional surprising moments for the passenger in the vehicle, because from the given progression of the guide track no conclusions can be drawn about the actual further progression of the vehicle. Contrary to a track arranged on a simple rocker, here the rider cannot draw conclusions about the progression of the travel of the vehicle simply by considering a rocker motion. This way, additional surprising moments can be provided for the passenger.

In an embodiment according to the invention the guide track is arranged between the first and the second pivotal axis, parallel in reference to a level which extends perpendicular to the axial direction of the first pivotal axis. The guide track may extend straight for example between the first and the second pivotal axis. Here, while the passenger rides on the rail, its incline can be variably adjusted with the help of the two pivotal axes. The rider then sees a straight section of track ahead, and while riding thereon it changes its incline. Of course, the guide track can also be extended in a curved fashion, with curved in this context representing that the guide track is distorted at least sectionally or that the guide track is arranged about a straight axis, for example on the jacket surface of a cylinder about the axis of the cylinder, helically winding at least about a section of the straight axis, i.e. the cylinder axis.

The first and/or the second pivotal axis may be mobile parallel and in reference to the direction of the guide track. This way, for example an additional level of freedom is provided when the guide track is moved for example with lifting rods.

In a preferred embodiment, the first axial direction is arranged parallel in reference to the second axial direction.

The fasteners of the guide track are arranged adjacent to each other, with the first fastening of the guide track being arranged adjacent to the second fastening of the guide track. Between the first and the second fastening the guide track shows preferably no additional fastening fixing the position of the guide track in reference to the erection site of the guide track, however at least no stationary fastening. Due to the fact that between the first and the second pivotal axis the guide track shows no locally fixed axial fastening, the impression of a collapsing track can also be realized for the passenger, for example by both pivotal axes moving downwards simultaneously.

In this case, the guide track is freely carried between the first fastening and the second fastening.

The first fastening is for example formed by a first lifting rod or by first lifting rods, arranged pivotally at the first pivotal axis. The second fastening can be formed by a second lifting rod or by second lifting rods, arranged pivotally at the second pivotal axis.

In order to create a relatively simple amusement ride, the first lifting rod and/or the first lifting rods may be connected to a stationary arranged motor drive, or alternatively connected to a motor drive guided at a stationary rail, with the angle of the first lifting rails changing in reference to the guide track when it the motor switched on. Such a motor may move back and forth for example the ends of the first lifting rod/lifting rods opposite the pivotal axis along a bottom rail connected fixed to the bottom, and here changing the angle between the first lifting rod/the first lifting rods and the bottom rails, which can lead to a change of the track elevation and the track incline of the guide track. In order to change the elevation of the track and the incline of the guide track the first and/or second lifting rods may also or additionally be guided in a respectively stationary fixed, pivotal guide sheath.

The first and/or second fastenings may of course also show other fixed or adjustable coupling elements, such as con-rods, shears, or the like.

In one advantageous embodiment the first and/or second lifting rods show lifting cylinders, or they are connected to lifting cylinders. When the lifting rods show lifting cylinders, the raising and lowering of the guide track can occur even without an additional drive, for example.

In order to allow quickly accelerating or braking the vehicle at the guide track, the vehicle shows for example wheels by which it can be moved on the guide track. The vehicle may furthermore show an additional drive engine and/or brakes. This way it is possible to accelerate and/or brake the vehicle independent from the progression of the guide track.

The guide track may show a reverse lock in order to fix the vehicle guided thereon at a certain point. Such a reverse lock creates an additional thrill for the rider.

A guide track is preferably arranged at least partially in a water reservoir, with it at least partially being arranged extending underneath the water level of the water reservoir. The guide track may be arranged extending completely in the water and for example extend underneath the water level. The guide track may for example be also arranged traveling into the water reservoir and movable out of said water reservoir. It is also possible to rotate the guide track in the water reservoir; for example, parallel to the water surface, or is tilted in the water reservoir in order to simulate the feeling of falling out, for example. A combination with water gives the passenger an additional amusement.

In this case, the vehicle is therefore advantageously a boat. The mobile guide track can then provide the feeling of a ship sailing on high waves.

The guide track may also be embodied as the watercraft itself. The first mobile fastening could be a first rope fastened at the watercraft, the second mobile fastening could be a second rope fastened at the watercraft. In this case the watercraft could be arranged in a mobile fashion in a water reservoir filled with water and pulled by the first and/or the second rope. The two ropes can be fastened to winches, which are arranged such that the watercraft can be tilted such that the watercraft can be entered for example in that it is tilted in the direction towards the entrance as explained in greater detail in the following in connection with on one of the exemplary embodiment.

The vehicle is advantageously moved from one end of the guide track to the other end of the guide track. This additionally ensures entertainment because the entire track and not only a section thereof is traveled. Thus, in a preferred amusement ride the guide track is connected at one of its ends to another guide track when the vehicle has reached at last one end of the guide track. Then the vehicle performs no back and forth motion on the guide track but moves in a predetermined direction and here travels only one once on the moved guide track and therefrom changes to another guide track.

In another embodiment the guide track may be embodied as a water slide. Then it may show several channels, preferably arranged parallel to each other and embodied as individual slides.

Each of the channels may show one or more differently deep depressions. For example, each of the channels may accept one passenger, or also several passengers, for example on a hoop, or be intended for an individual rider. On such a water slide, therefore several persons can slide down the waterslide side-by-side. In one embodiment the speed of sliding can be controlled via the individual channels, preferably separately, by the supply of the water volume. Additionally, such a water slide can ensure, for example in the sliding direction during the sliding process by way of a change of its decline according to the invention that the sliding speed of the rider can additionally be increased or reduced. For example, competitions can be held between riders arranged sliding on different individual slides. In the embodiment in which the depths of the individual depressions of adjacent individual slides are embodied differently, the neighboring rider can partially be invisible for the rider and then suddenly reappear, which may lead to additionally thrilling moments during the joint ride. A potential embodiment would also be a contact option, by which each sliding party could confirm completion of the ride and thus a timer for the competition could be provided.

At the ends of the guide track embodied as a waterslide with several individual slides extensions and/or brake sections may be embodied so that starting at a certain elevation of the guide track the rider can automatically slide out. If necessary, additional holding devices or automatically controlled gates may be provided. Safety nets may also be provided at the sides of the guide track and/or at its ends.

The motion effects of the guide track, for example the waterslide, can be freely programmable so that different progressions of motion can be realized.

The designations used in the following description, such as top, bottom, left, and right and the like refer to the exemplary embodiments and shall not be considered limiting in any way, even when they refer to a preferred embodiment.

In the following, the invention is explained in greater detail based on a the figures submitted herewith.

DETAILED DESCRIPTION OF THE FIGURES

FIG. 1 shows a schematic lateral cross-section of an amusement ride 1 at a certain point of time with a guide track 2, on which a vehicle 4 moves in a guided fashion. The guide track 2 is provided at a first pivotal axis 6 as well as at a second pivotal axis 8 with fastenings 10, 12. The first pivotal axis 7 is fastened in a mobile fashion with the first fastening 10, the second pivotal axis 8 is fastened in a mobile fashion with the second fastening 12. In the example shown the first fastening 10 is a first lifting rod and the second fastening 12 is a second lifting rod. A first motor drive 14 is arranged at the end of the first lifting rod opposite the pivotal axis 6. A second motor drive 16 is arranged at the end of the lifting rod opposite the second pivotal axis 8. The two motors 14, 16 are embodied as linear motors, which are formed in a bottom rail 18 connected fixed to the ground, which is embodied in a depression 20 of the amusement ride 1, mobile back and forth. When the two linear motors 14, 16 move towards each other in the bottom rail 18, the angle changes between the track 2 and the first lifting rod as well as the angle between the track 2 and the second lifting rod. In the present example the lifting rods show a fixed length, however they may also show a variable length. By changing the angle between the track 2 and the first and second mobile fastenings 10,12, embodied as lifting rods, the track 2 is guided in a mobile fashion at the first pivotal axis 6 and at the second pivotal axis 8. A left track support 22 and a right track support 24 ensure that the guide track 2 can be pivoted in an articulate fashion between the two track support points. A left stop edge 26 and a right stop edge 28 ensure in the present exemplary embodiment that the vehicle 4 cannot leave the track 2.

Of course, it is also possible to provide the amusement ride 1 as a section of a longer track. For example, instead of the left stop edge 26 at one end of the guide track 2 here a first guide track may be provided, from which the vehicle 4 reaches the track section, the guide track 2. As soon as the vehicle 4 is located on the guide track 2, the guide track 2 can be raised by the lifting devices 10, 12, 14, 16, for example at the left side. Optionally, until the guide track 2 has been lifted, the vehicle 4 may be held at a certain point of the guide track 2 and then be released. The vehicle 4 may then travel on the guide track 2 until reaching the other end. At the moment the vehicle 4 reaches the other end of the guide track 2, the guide track 2 is connected to a second guide track so that the vehicle 4 can immediately continue traveling on the second guide track. This way, many additionally interesting effects can be integrated in a track.

The guide track 2 may also be guided directly into a water reservoir during the tilting process, for example, so that it ultimately is arranged at least partially underneath the water level of the water reservoir. The vehicle 4, for example moving from the left towards the right, may be embodied as a boat and can then directly continue moving on the track 2.

The invention was explained based on preferred exemplary embodiments without being limited to these exemplary embodiments. The features of the individual embodiments can be freely combined or exchanged with functionally equivalent features of other embodiments, assuming compatibility.

For example, the vehicle can also be held redundantly via the return block when it has reached the end of the guide track 2, and for example automatically be disconnected when an apex has been reached.

The motion of the pivotal points 6, 8 can occur for example via lifting cylinders or con rods or ropes. The first and second mobile fastenings 10, 12, embodied as first and second lifting rods, respectively, may be arranged aligned parallel in reference to each other and for example coupled to each other via lateral rods showing a fixed length.

Instead of one or in addition to one or more linear motor drives the amusement ride may show a pneumatic device for raising and lowering the first and second pivotal points.

The guide track 2 may also show additional weights between the first pivotal axis 6 and the second pivotal axis 8 in order to ensure that the center of gravity of the guide track 2 is always and in any case is located between the two pivotal axes 6 and 8, regardless of the present position of the vehicle 4 and independent from the present position of the guide track 2.

One trained in the art will know many such or similar embodiments of the mobile guide track 2, without here leaving the concept of the invention.

Figure 2:
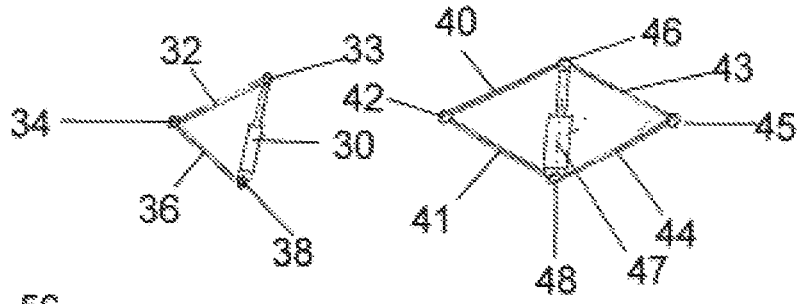
FIG. 2 is a line drawing evidencing two lifting devices embodied as shears.

FIG. 2 shows two of them embodied as shearing mechanisms, which can stabilize the stroke direction of the lifting cylinder 30. Such mechanisms can for example be provided as lifting mechanisms for the motion of the guide track 2.

The left embodiment of FIG. 2 shows a lifting cylinder 30, which is connected to a first shearing arm 32 at a joint 33. The first shearing arm 32 is connected to the joint 34 in an articulate fashion via a second shearing arm 36. The second shearing arm 36 is fastened in an articulate fashion to the other end of the lifting cylinder 30 at a stationary fixation 38. The joint 34 can for example be guided in a guiding groove (not shown) of a stationary arranged plate (not shown either) so that the lifting device can be operated such that the joint 33 is mobile diagonally upwards and downwards.

The right embodiment of FIG. 2 shows the example of another lifting mechanism. The shearing arms 40, 41 are connected to each other in an articulate fashion at a joint 42. The shearing arms 43, 44 are connected in an articulate fashion to another joint 45 embodied as a stationary fixation. The shearing arms 40, 43 are connected in an articulate fashion via a joint 46 to the lifting cylinder 47. The shearing arms 41 and 44 are also connected in an articulate fashion via a joint 48 to the lifting cylinder 47. By changing the stroke of the lifting cylinder 47 here for example the distance can be varied between the joints 42 and 45.

Figure 3:
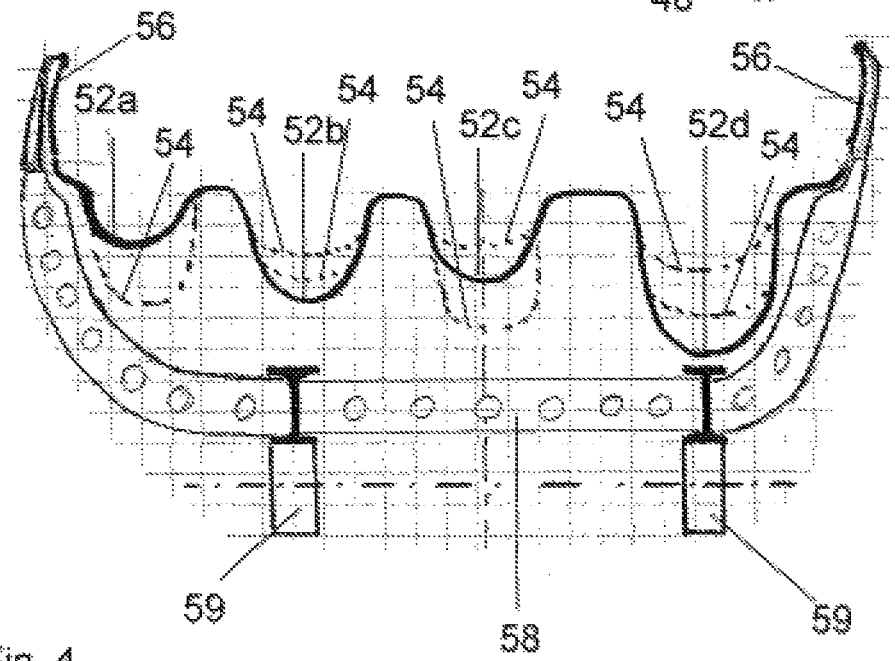
FIG. 3 is a line drawing evidencing an amusement ride embodied as a waterslide in a cross-section perpendicular in reference to the direction of motion.

FIG. 3 shows another amusement ride 1 according to the invention in a cross-section perpendicular in reference to the direction of motion of the passenger 50. The amusement ride 1 shows a guide track 2 embodied as a waterslide 51, with embodied channels 52*a*, 52*b*, 52*c*, 52*d* arranged parallel side-by-side and embodied as individual slides. Each channel 52*a*, 52*b*, 52*c*, 52*d* shows in the direction of travel one or more depressions 54 (indicated in dot-dash lines) embodied with different depths. The waterslide 51 shows further safety nets 56 at its lateral boundaries, which ensure that the passengers cannot fall out when the slide moves for example laterally. The waterslide 51 is further supported in an articulate fashion in a bottom splash 58, which is anchored in this exemplary embodiment via the ground anchors 59 at the floor. Alternatively the waterslide 51 can also be connected fixed to the bottom splash 58. The bottom splash 58 may alternatively show articulate lifting cylinders instead of ground anchors 59, which allow moving the bottom splash 58 in reference to the floor.

Figure 4:
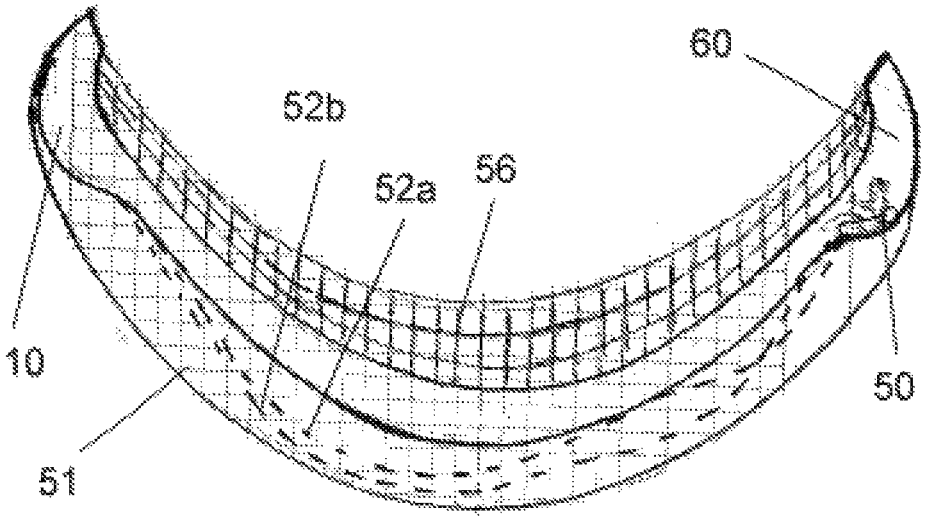
FIG. 4 is a line drawing evidencing a waterslide along the direction of motion.

FIG. 4 shows a side view of the waterslide along the direction of motion of the passenger 50. Via an entrance 60 of the waterslide 51, which may be embodied slightly widened, the passenger 50, who may for example move in a watercraft or may also be sitting on the floor of the water slide 50, can glide in a guided fashion on a channel 52*a* of the waterslide 51, and can then ride along the direction of motion (in FIG. 4 from the right to the left, and/or from left to right) following the channel 52*a*, which shows a first number of depressions 54 embodied with different depths, (indicated in dot-dash lines in FIG. 4). At the end of the channel 52*a* the passenger 50 leaves the waterslide 51 via an outlet 62, embodied as a brake section. A second passenger can for example be guided over the entrance 60, for example to the channel 52*b* of the waterslide 51, and then ride along a second number of depressions 54 embodied with different depths in the direction of motion (also shown in dot-dash lines in FIG. 4). This way several passengers can ride side-by-side in different channels with different speeds down the waterslide.

In a preferred embodiment the individual channels 52*a*, 52*b*, 52*c*, 52*d* of the water slide 51 may be impinged with different volumes of water per time unit, in order to more or less accelerate the passenger 50, for example. In one advantageous embodiment the passenger could already during the ride through the channels, for example via sensor elements arranged in the channels, control his/her ride independently by contacting them during the ride.

It is discernible from the above-explained exemplary embodiments that the guide track 2 can rotate both in the longitudinal direction and/or in its height and/or about its own axis, so that a passenger in the vehicle 4, in case of an appropriate arrangement of the lifting device explained, can seemingly be subjected to undefined progressions of motion. Although in the above-stated exemplary embodiments it is always discussed that the entire amusement ride 1 is placed on a stationary platform with a bottom rail 18, it is of course also possible that the bottom rail 18 is fastened on a rotating platform.

Figure 5:
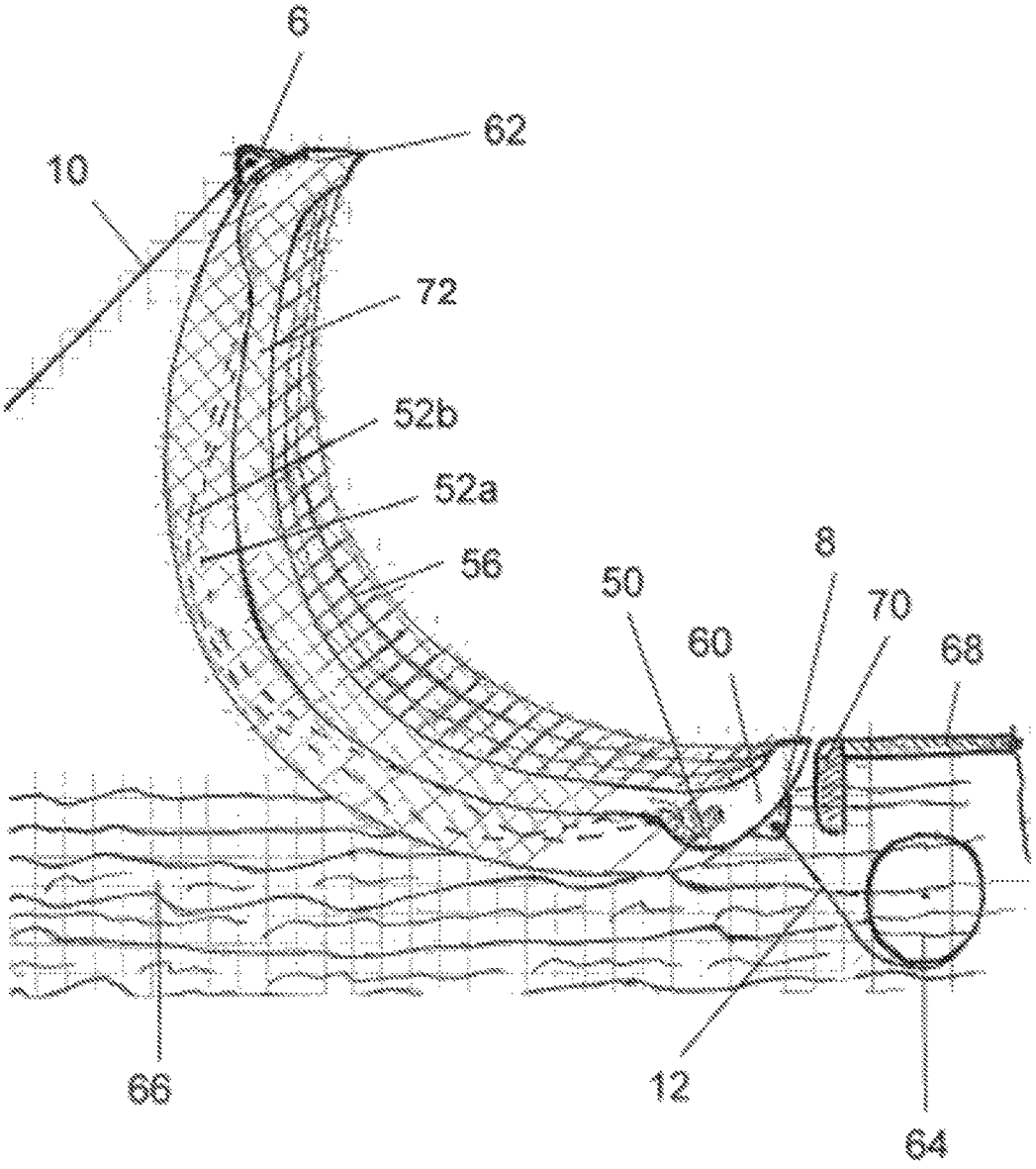
FIG. 5 is a line drawing evidencing another embodiment of the amusement ride according to the invention.

FIG. 5 shows an exemplary embodiment of another implementation of the amusement ride according to the invention. A guide track (2) embodied as a watercraft (72) is fastened at a first mobile fastening (10) embodied as a first pulley and pivotal at the first pivotal axis (6). The first pivotal axis (6) is embodied as an opening for a rope at one end of the watercraft (72). The first pulley can for example be connected to a first winch (not shown). The second pivotal axis (8) may be embodied at the other end of the watercraft (72) as a second opening for a rope and fastened at a second mobile fastening (12) pulley embodied as a second pulley. The second mobile fastening 12) embodied as a second pulley is connected to a second winch (64). The watercraft (72) is arranged floating on a water surface (66).

In order to allow that passengers (50) can reach the watercraft (72) and the entrance (50) via the pier (68), the second pulley is rolled up on the second winch (64), which in the exemplary embodiment is arranged underneath the water surface (66), to such an extent that the pier (68) and the entrance (60) of the watercraft (72) are arranged approximately on the same level above the water surface (66). A buffer (70) ensures that by a back and forth motion of the watercraft (72) on the water surface (66) the watercraft (72) is not damaged at the edge of the pier (68). The passenger (50) then reaches, for example on or with the loop, the entrance part of the watercraft (72). For an additional amusement of the passenger (50) the watercraft (72) may be embodied for example as a waterslide (51), for example as shown in the exemplary embodiment of FIG. 4. As soon as the passenger (50) has reached the entrance (60) of the watercraft (72), the second pulley is quickly unrolled from the second winch (64) so that the entrance (60) of the watercraft (72) pivots upwards and the passenger (50) slides or can slide for example along the guide track (2) in the direction of the exit (62). While the second winch (64) is quickly unwound, for example the first winch can be quickly wound up so that the passenger (50) can leave again the watercraft (72) via the exit (62) at the side opposite the pier at the side of another pier arranged at the opposite side of the watercraft (72).

Of course it is also possible that by a repeated back and forth pivoting of the watercraft (72) the passenger (50) is repeatedly moved back and forth on the guide track (2) and for example at the end of the amusement is thrown into the water (66) via the exit (62).

The invention has been explained based on preferred exemplary embodiments without being limited to these exemplary embodiments. The features of individual embodiments can be freely combined with features of other embodiments in order to form new embodiments to the extent compatibility is given. For example, the watercraft in FIG. 5 can be embodied as a waterslide as in FIG. 4 or as a guide track as in FIG. 1, for example a vehicle (4) in which the passenger takes a seat. The first and/or second pulley shown for example in FIG. 5 may also be replaced by a lifting device with lifting cylinders. One trained in the art knows numerous deviations and embodiments of the device according to the invention, without here leaving the concept of the invention.

LIST OF REFERENCE NUMBERS

1 amusement ride
2 guide track
4 vehicle
6 first pivotal axis
8 second pivotal axis
10 first mobile fastening
12 second mobile fastening
14 first motor drive
16 second motor drive
18 bottom rail
20 depression
22 left track support
24 right track support
26 left stop edge
28 right stop edge

30 lifting cylinder
32 shearing arm
33 joint
34 joint
36 shearing arm
38 stationary fixation
40 shearing arm
41 shearing arm
42 joint
43 shearing arm
44 shearing arm
45 stationary fixation
46 joint
48 joint
50 passenger
51 waterslide
52*a* channel
52*b* channel
52*c* channel
52*d* channel
54 depression
56 safety net
58 bottom splash
59 bottom anchoring
60 entrance, inlet
62 exit, outlet, brake section
64 winch
66 water surface
68 pier
70 buffer The references recited herein are incorporated herein in their entirety, particularly as they relate to teaching the level of ordinary skill in this art and for any disclosure necessary for the commoner understanding of the subject matter of the claimed invention. It will be clear to a person of ordinary skill in the art that the above embodiments may be altered or that insubstantial changes may be made without departing from the scope of the invention. Accordingly, the scope of the invention is determined by the scope of the following claims and their equitable equivalents.

The invention claimed is:

1. An amusement ride comprising a guide track which comprises a first pivotal axis for the mobile guidance of a guide track as well as a second pivotal axis for the mobile guidance of the guide track, a first mobile fastening, as well as a second mobile fastening, with the guide track being articulably fastened with the first mobile fastening at the first pivotal axis and being mobilely and pivotally fastened with the second mobile fastening at the second pivotal axis, wherein the first pivotal axis is pivotal about at least a first axial direction and the second pivotal axis is pivotal about at least a second axial direction, wherein the first fastening is formed by first lifting rods, which are arranged pivotally at the first pivotal axis, and the second fastening is formed by second lifting rods, which are arranged pivotally at the second pivotal axis.

2. The amusement ride according to claim 1, wherein the pivotal axes are mobile such that the guide track can be moved translationally.

3. The amusement ride according to claim 1, wherein the first axial direction is arranged aligned at the first pivotal axis perpendicular in reference to the direction of the guide track.

4. The amusement ride according to claim 1, wherein the guide track comprises at least one vehicle guided mobilely and held at a guide track.

5. The amusement ride according to claim 1, wherein the guide track is arranged extending between the first pivotal axis and the second pivotal axis parallel in reference to a level which is perpendicular to the axial direction of the first pivotal axis.

6. The amusement ride according to claim 1, wherein the guide track extends between the first and the second pivotal axis in a straight or twisted line.

7. The amusement ride according to claim 5, wherein the first and the second pivotal axis are mobile parallel in reference to the direction of the guide track.

8. The amusement ride according to claim 1, wherein the first axial direction is parallel in reference to the second axial direction.

9. The amusement ride according to claim 1, wherein the first fastening of the guide track is arranged adjacent to the second fastening of the guide track, wherein the guide track is freely carried between the first and second fastenings, comprising no fastening fixing the position of the guide track in reference to the erection site of the guide track or no fastening holding the guide track.

10. The amusement ride according to claim 8, wherein the first lifting rods are connected to a stationary arranged motor drive which changes the angle of the lifting rods in reference to the guide track when it is switched on.

11. The amusement ride according to claim 8, wherein the first and second lifting rods comprise lifting cylinders or are connected to lifting cylinders.

12. The amusement ride according to claim 1, wherein the vehicle comprises wheels, by which it can be moved on the guide track.

13. The amusement ride according to claim 1, further comprising wherein the vehicle comprises a drive motor as well as brakes.

14. The amusement ride according to claim 1, wherein the guide track is at least partially arranged in a water reservoir, with the guide tack being at least partially arranged underneath the water level of the water reservoir.

15. The amusement ride according to claim 1, wherein the vehicle is a boat.

16. The amusement ride according to claim 1, wherein the guide track is a watercraft, the first mobile fastening is a first rope fastened at the watercraft, and the second mobile fastening is a second rope fastened at the watercraft.

17. The amusement ride according to claim 1, wherein the vehicle can be moved from one end of the guide track to the other end of the guide track.

18. The amusement ride according to claim 1, wherein the guide track is connected at least at one of its ends to another guide track, when the vehicle has reached at least one end of the guide track.

19. The amusement ride according to claim 1, wherein the guide track is embodied as a waterslide.

20. The amusement ride according to claim 19, wherein the waterslide comprises several channels embodied parallel in reference to each other as individual slides.

* * * * *